US011878386B2

(12) United States Patent
Eriksson et al.

(10) Patent No.: US 11,878,386 B2
(45) Date of Patent: Jan. 23, 2024

(54) AUTOMATIC BLADE HOLDER

(71) Applicant: PROSHARP INC., Worcester, MA (US)

(72) Inventors: Magnus Eriksson, Njurunda (SE); Anton Åström, Bromma (SE)

(73) Assignee: PROSHARP INC.

( * ) Notice: Subject to any disclaimer, the term of this patent is extended or adjusted under 35 U.S.C. 154(b) by 870 days.

(21) Appl. No.: 16/854,433

(22) Filed: Apr. 21, 2020

(65) Prior Publication Data

US 2021/0069850 A1 Mar. 11, 2021

Related U.S. Application Data

(60) Provisional application No. 62/898,989, filed on Sep. 11, 2019.

(51) Int. Cl.

*B24B 3/00* (2006.01)
*B24B 49/00* (2012.01)
*B24B 41/06* (2012.01)

(52) U.S. Cl.

CPC ..... *B24B 3/003* (2013.01); *B24B 41/06* (2013.01); *B24B 49/00* (2013.01)

(58) Field of Classification Search

CPC .. B24B 3/00; B24B 3/003; B24B 9/04; B24B 21/002; B24B 41/06; B24B 41/066; B24B 49/16; B24D 15/066

See application file for complete search history.

(56) References Cited

U.S. PATENT DOCUMENTS 3,956,857 A * 5/1976 Weisman ..... B24B 21/002 451/303
3,988,865 A * 11/1976 Weisman ..... A63C 3/10 269/196
4,993,725 A 2/1991 Barnes
5,103,597 A 4/1992 Courchesne
5,127,194 A 7/1992 Jobin
5,167,170 A 12/1992 Croteau
5,189,845 A 3/1993 Courchesne
5,195,277 A 3/1993 Courchesne
5,197,232 A 3/1993 Ellestad
5,239,785 A 8/1993 Allen (Continued)

FOREIGN PATENT DOCUMENTS

CA 2217783 A1 6/1999
DE 112020003834 4/2022

(Continued)

OTHER PUBLICATIONS

International Search Report and Written Opinion dated Nov. 17, 2020 in connection with International Patent Application No. PCT/US2020/049172, 5 pages.

(Continued)

*Primary Examiner* — Joel D Crandall
*Assistant Examiner* — Makena S Markman

(57) ABSTRACT

The blade holder has a movable plate and a fixture. A rotatable bolt in operative engagement with a block attached to the plate. A motor is in operative engagement with the bolt. The motor rotates the bolt to move the plate towards the fixture to grip a first set of blades until a torque threshold value is reached. The processor determines a number of blades included in the set of blades based on the number of rotations of the bolt. A first grinding portion of a rotating abrasive belt is applied against the set of blades (having width (W1)) to sharpen the set of blades. Sliding a vise sideways a distance (W1) until a second grinding portion is aligned on top of the second set of blades.

9 Claims, 5 Drawing Sheets

(56) References Cited

U.S. PATENT DOCUMENTS

| | | | | |
|---|---|---|---|---|
| 5,287,657 | A | 2/1994 | Tschida et al. | |
| 5,345,688 | A | 9/1994 | Allen | |
| D352,880 | S | 11/1994 | Anderson | |
| 5,381,629 | A | 1/1995 | Salvail | |
| 5,383,307 | A | 1/1995 | Anderson | |
| 5,431,597 | A | 7/1995 | Anderson | |
| 5,445,050 | A | 8/1995 | Owens | |
| 5,492,037 | A | 2/1996 | Graham | |
| 5,499,556 | A | 3/1996 | Exner et al. | |
| 5,547,416 | A | 8/1996 | Timms | |
| 5,564,973 | A | 10/1996 | Salvail | |
| 5,569,064 | A | 10/1996 | Gleadall | |
| 5,582,535 | A | 12/1996 | Friel | |
| 5,591,069 | A | 1/1997 | Wurthman | |
| 5,601,473 | A * | 2/1997 | Strain | B24B 3/003 451/10 |
| 5,607,347 | A | 3/1997 | Schoen et al. | |
| 5,704,829 | A | 1/1998 | Long | |
| D390,084 | S | 2/1998 | McCabe | |
| D392,536 | S | 3/1998 | Anderson | |
| D394,196 | S | 5/1998 | Richardson | |
| 5,791,974 | A | 8/1998 | Sakcriska | |
| 5,879,229 | A | 3/1999 | Anderson | |
| 5,897,428 | A | 4/1999 | Sakcriska | |
| 5,916,018 | A | 6/1999 | Watt | |
| 6,030,283 | A | 2/2000 | Anderson | |
| 6,067,880 | A | 5/2000 | Arrigoni | |
| 6,116,989 | A | 9/2000 | Balastik | |
| 6,218,639 | B1 * | 4/2001 | Bulle | B23K 37/0241 219/121.36 |
| 6,312,017 | B1 | 11/2001 | Hardwick et al. | |
| 6,422,934 | B1 | 7/2002 | Blach et al. | |
| 6,443,819 | B2 | 9/2002 | Sakcriska | |
| 6,481,113 | B1 | 11/2002 | Brenner et al. | |
| 6,579,163 | B1 | 6/2003 | Ross et al. | |
| 6,594,914 | B1 | 7/2003 | Babcock | |
| 6,726,543 | B1 | 4/2004 | Klosterman | |
| 6,761,363 | B2 | 7/2004 | Fask et al. | |
| 7,097,547 | B2 | 8/2006 | McCroary | |
| D529,361 | S | 10/2006 | Brookman | |
| 7,191,539 | B2 | 3/2007 | Zukerman | |
| 7,220,161 | B2 | 5/2007 | Eriksson | |
| 7,434,324 | B2 | 10/2008 | McKenna | |
| 7,473,164 | B2 | 1/2009 | Sunnen | |
| 7,547,022 | B2 | 6/2009 | Broadbent | |
| D603,432 | S | 11/2009 | Wilson et al. | |
| 7,748,130 | B2 | 7/2010 | McKenna | |
| 7,918,035 | B1 | 4/2011 | Jarczewski | |
| 7,934,978 | B2 | 5/2011 | Wilson et al. | |
| 8,047,552 | B2 | 11/2011 | Julien | |
| 8,277,284 | B2 | 10/2012 | Wilson et al. | |
| 8,430,723 | B2 | 4/2013 | Moon | |
| 8,574,030 | B2 | 11/2013 | Wilson et al. | |
| 8,827,768 | B2 | 9/2014 | Allen | |
| 8,851,961 | B2 | 10/2014 | Frommer et al. | |
| 8,888,567 | B2 | 11/2014 | Allen et al. | |
| 8,944,889 | B2 | 2/2015 | Frommer et al. | |
| D725,453 | S | 3/2015 | Lodato et al. | |
| 9,114,498 | B1 | 8/2015 | Layton et al. | |
| 9,242,330 | B1 | 1/2016 | Layton et al. | |
| 9,259,637 | B2 | 2/2016 | Wilson et al. | |
| 9,308,613 | B2 | 4/2016 | Eriksson | |
| 9,339,911 | B2 | 5/2016 | Eriksson | |
| 9,352,437 | B2 | 5/2016 | Layton et al. | |
| 9,352,444 | B2 | 5/2016 | Layton et al. | |
| 9,475,175 | B2 | 10/2016 | Layton et al. | |
| 9,480,903 | B2 | 11/2016 | Wilson et al. | |
| 9,517,543 | B2 | 12/2016 | Proulx | |
| 9,566,682 | B2 | 2/2017 | Layton et al. | |
| 9,573,236 | B2 | 2/2017 | Layton et al. | |
| 9,651,466 | B2 | 5/2017 | Brown et al. | |
| 9,669,508 | B2 | 6/2017 | Layton et al. | |
| D793,830 | S | 8/2017 | Layton et al. | |
| 9,895,786 | B2 | 2/2018 | Frommer et al. | |
| 9,895,791 | B2 | 2/2018 | Bleier | |
| 9,897,430 | B2 | 2/2018 | Layton et al. | |
| 9,902,035 | B2 | 2/2018 | Layton et al. | |
| 10,065,282 | B2 | 9/2018 | Layton et al. | |
| D845,793 | S | 4/2019 | Di Nardo et al. | |
| 10,300,574 | B2 | 5/2019 | Layton et al. | |
| 10,335,925 | B2 | 7/2019 | Layton et al. | |
| 10,384,329 | B2 | 8/2019 | Downen | |
| 10,406,647 | B2 | 9/2019 | Tatomir | |
| 10,500,463 | B2 | 12/2019 | Stastny et al. | |
| 10,533,834 | B2 | 1/2020 | Di Nardo et al. | |
| 10,583,347 | B2 | 3/2020 | Proulx | |
| 10,926,379 | B2 | 2/2021 | Bleier | |
| 11,103,974 | B2 | 8/2021 | Chan et al. | |
| 11,148,035 | B2 | 10/2021 | Shaffer | |
| 2003/0148716 | A1 | 8/2003 | Lyons | |
| 2004/0244538 | A1 | 12/2004 | Franzen et al. | |
| 2005/0029755 | A1 | 2/2005 | Fask et al. | |
| 2005/0130571 | A1 | 6/2005 | Sunnen | |
| 2006/0065076 | A1 | 3/2006 | Friol | |
| 2006/0183411 | A1 | 8/2006 | Moon | |
| 2006/0223419 | A1 | 10/2006 | Moon | |
| 2007/0068022 | A1 | 3/2007 | McKenna | |
| 2009/0206562 | A1 | 8/2009 | Podolsky | |
| 2009/0206563 | A1 | 8/2009 | Ferras | |
| 2010/0201088 | A1 | 8/2010 | Newman et al. | |
| 2011/0203416 | A1 | 8/2011 | Grodin | |
| 2012/0104705 | A1 | 5/2012 | Swist | |
| 2012/0108151 | A1 | 5/2012 | Swist | |
| 2012/0227204 | A1 | 9/2012 | Maye | |
| 2014/0090445 | A1 * | 4/2014 | Norman | G01N 3/56 73/7 |
| 2014/0225337 | A1 | 8/2014 | Olson | |
| 2015/0140901 | A1 | 5/2015 | Eriksson | |
| 2015/0140902 | A1 | 5/2015 | Eriksson | |
| 2015/0367224 | A1 | 12/2015 | Schatz | |
| 2016/0059107 | A1 | 3/2016 | Finley | |
| 2016/0096252 | A1 | 4/2016 | Layton et al. | |
| 2016/0250732 | A1 | 9/2016 | Layton et al. | |
| 2017/0320184 | A1 | 11/2017 | Tatomir | |
| 2018/0126250 | A1 * | 5/2018 | Proulx | G01N 3/56 73/7 |
| 2019/0038957 | A1 | 2/2019 | Histed et al. | |
| 2019/0176292 | A1 | 6/2019 | Chan et al. | |
| 2020/0206878 | A1 | 7/2020 | Downen | |
| 2020/0309499 | A1 | 10/2020 | Hauer | |
| 2020/0316745 | A1 | 10/2020 | Maxwell | |
| 2020/0338691 | A1 | 10/2020 | Downen | |
| 2021/0069850 | A1 | 3/2021 | Eriksson et al. | |
| 2021/0069853 | A1 | 3/2021 | Berglund et al. | |
| 2021/0162561 | A1 | 6/2021 | Chan et al. | |
| 2021/0308835 | A1 | 10/2021 | Bleier | |
| 2021/0346783 | A1 | 11/2021 | Stuhr et al. | |
| 2022/0040812 | A1 | 2/2022 | Eriksson et al. | |
| 2022/0212308 | A1 | 7/2022 | Berglund et al. | |

FOREIGN PATENT DOCUMENTS

| | | | | |
|---|---|---|---|---|
| DE | 112020003835 | | 4/2022 | |
| EP | 0035939 | B1 | 5/1983 | |
| EP | 0128430 | | 8/1988 | |
| EP | 1584410 | | 10/2005 | |
| EP | 3071367 | | 11/2022 | |
| GB | 608207 | | 9/1948 | |
| SE | 143315 | | 2/1986 | |
| SE | 527015 | | 12/2005 | |
| SE | 545052 | C2 | 3/2023 | |
| SE | 545053 | C2 | 3/2023 | |
| WO | WO-2016183663 | A1 * | 11/2016 | A63C 3/10 |
| WO | 2021/050349 | | 3/2021 | |
| WO | 2021/050351 | | 3/2021 | |

OTHER PUBLICATIONS

International Search Report and Written Opinion dated Nov. 19, 2020 in connection with International Patent Application No. PCT/US2020/049166, 5 pages.

(56) References Cited

OTHER PUBLICATIONS

International Preliminary Report on Patentability dated Mar. 15, 2022 in connection with International Patent Application No. PCT/US2020/049172, 4 pages.
International Preliminary Report on Patentability dated Mar. 15, 2022 in connection with International Patent Application No. PCT/US2020/049166, 4 pages.
Notice of Allowance (Final Notice) issued by the Swedish Patent Office dated Oct. 14, 2022 in connection with Swedish Patent Application No. 2250329-6, 3 pages.
Notice of Allowance (Final Notice) issued by the Swedish Patent Office dated Oct. 14, 2022 in connection with Swedish Patent Application No. 2250328-8, 3 pages.
Swedish Search Report issued by the Swedish Patent Office dated Oct. 14, 2022 in connection with Swedish Patent Application No. 2250329-6, 2 pages.
Swedish Search Report issued by the Swedish Patent Office dated Oct. 14, 2022 in connection with Swedish Patent Application No. 2250328-8, 3 pages.
Notice of Allowance issued by the European Patent Office dated May 30, 2022 in connection with European Patent Application No. 14864954.4, 7 pages.
Restriction requirement dated Mar. 23, 2023 in connection with United States U.S. Appl. No. 16/988,610, 6 pages.
Restriction requirement dated Apr. 11, 2023 in connection with U.S. Appl. No. 17/508,199, 8 pages.
Excerpt from Marinescu et al., Tribology and Fundamentals of Abrasive Machining Processes, 2nd edition, 2013, Chapter 9.9.4, consulted on Jun. 12, 2023 https://www.sciencedirect.com/topics/engineering/abrasive-belts.
Notice of Allowance dated Jun. 28, 2023 in connection with U.S. Appl. No. 16/988,610, 12 pages.

* cited by examiner

AUTOMATIC BLADE HOLDER

PRIOR APPLICATION

This is a U.S. utility patent application that claims priority from U.S. provisional patent application No. 62/898,989, filed 11 Sep. 2019.

TECHNICAL FIELD

The invention relates to an automatic blade holder that automatically senses the number of blades held in the blade holder and horizontally shifts the blades upon completion to make sure the next time the blade holder is used, a non-worn portion of the grinding belt aligned on top of the next batch of blades to be sharpened.

BACKGROUND AND SUMMARY OF THE INVENTION

Sharpening apparatuses for grinding or sharpening blades such as skate blades have been available for decades. However, the prior art sharpening apparatuses are often manual and require extensive skills and experience of the person doing the sharpening. This results in varying sharpening results and makes it more difficult for users of skate blades to obtain properly sharpened skate blades. There is a need for an effective sharpening method and apparatus that is easy to use while providing consistent and high-quality sharpening of skate blades. There is a need for a better and a more reliable blade holder used for sharpening blades.

The automatic blade holder of the present invention provides a solution to the above-outlined problems. More particularly, the blade holder of the present invention has a movable plate and a fixture. A rotatable bolt is in operative engagement with a block attached to the plate. A motor is in operative engagement with the bolt. The motor rotates the bolt to move the plate towards (or away from) the fixture to grip a first set of blades until a torque threshold value is reached. The processor determines a number of blades included in the set of blades based on the number of rotations of the bolt when the torque threshold value is reached. A first grinding portion of a rotating abrasive belt is applied against the first set of blades, wherein the first set of blades has a total width W1, to sharpen the set of blades. A vise is slid sideways a distance W1 until a second grinding portion is aligned on top of the second set of blades.

The method further comprises the step of the motor automatically reducing a gripping force for a second set of blades wherein the second set of blades includes fewer blades than the first set of blades.

The method further comprises the step of sliding a slide, attached to the vise, along a rail to shift the vise relative to the belt.

The method further comprises the step of providing a linear actuator that has a rod in rotational engagement with a bolt secured to a piece in operational engagement with the slide.

The method further comprises the step of simultaneously sharpening the blades contained in the first set of blades.

The method further comprises the step of rotating the rod to shift the vise relative to the belt (186).

The method further comprises the step of inserting a motor shaft into the bolt.

The method further comprises the step of providing the block with an opening defined therein to threadedly engage the bolt.

The method further comprises the step of determining a gripping gap between the plate and the fixture by counting a number of rotations of the shaft.

The method further comprises the step of providing the shaft with an elongate protrusion and inserting the protrusion into a groove at an end of the bolt.

DETAILED DESCRIPTION

Figure 1:
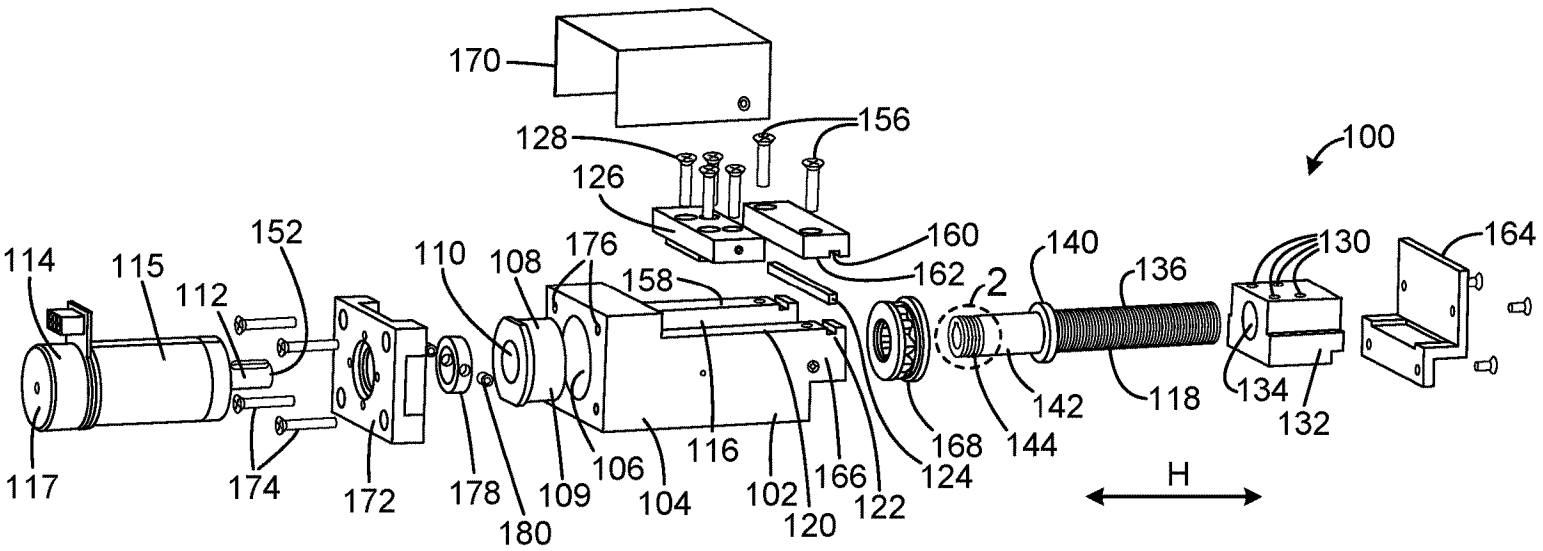
FIG. 1 is an exploded side view of a portion of the blade holder of the present invention.
Figure 2:
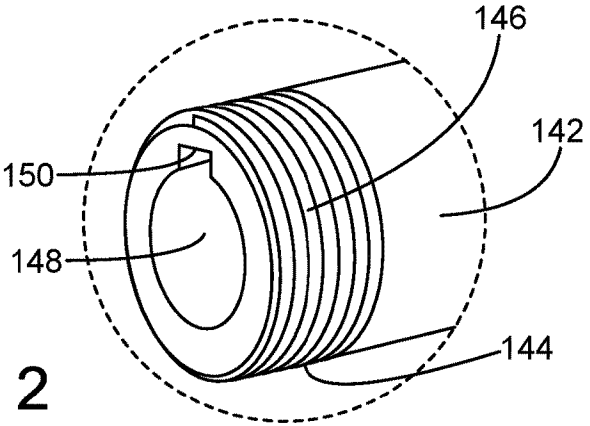
FIG. 2 is a detailed view of the end of the smooth section of the present invention.

With reference to FIG. 1, the blade holder 100 has a sturdy vise 102 that acts as a frame for all other components and is designed to withstand all the forces that is applied thereon. The blade holder 100 is very compact. An important feature of the blade holder is that it can automatically determine how many blades are to be sharpened and how hard the blades should be clamped or held together. In other words, the blade holder 100 automatically adjusts the gripping force or torque value depending on how many blades are to be simultaneously sharpened. It can also automatically shift the entire holding mechanism so that a new non-worn portion of the sharpening belt is aligned with the next batch of blades that are to be sharpened by the belt.

The vise 102 has a hollow space 116 defined therein to receive a rotatable threaded bolt 118, as explained in detail below. The vise 102 has, at one end 104, a round opening 106 defined therein and therethrough to receive a round inset 108. The inset 108 has a round opening 110 defined therein to receive a rotatable motor shaft 112 extending from a gearbox 115 of an electric motor 114. The inset 108 prevents horizontal movement of the bearing 168 and has an outside thread 109 that is screwed into the round opening 106. The motor 114 has an encoder 117 that measures and monitors the number of rotations of the shaft 112. An upper side 120 of the vise 102 has a groove 122 defined therein to receive a wedge 124. A plate 126, having bolts 128, rests on the upper side 120 of vise 102. The bolts 128 are screwed into threaded openings 130 defined in a shiftable or movable block 132 to hold the plate 126 to the block 132. The block 130 has a round opening 134 defined therein to receive a threaded portion 136 of the bolt 118. The plate 126 may be integral with the block 132.

As explained below, by keeping track of the number of rotations of the shaft 112, it is possible to determine how much the plate 126 has been shifted horizontally relative to the fixture 154 and how big the gripping gap 119 (best shown in FIG. 3) is between an engagement surface 121 of the plate 126 and an opposite engagement surface 123 the fixture 154. It is also possible to determine the size of the gap 119 by sensing the position of the plate 126 with a position sensor without measuring the number of rotations of the shaft 112.

The bolt 118 has a flange 140 that has a diameter greater than a diameter of the threaded portion 136. One function of the flange 140 is to prevent horizontal movement of the bolt 118 during operation of the blade holder 100. The flange 140 separates the threaded portion 136 from a smooth section 142. At an end 144 of the smooth section 142, there is a threaded section 146 that has an opening 148 defined therein. The opening 148 has a cut-out 150 defined therein to receive an elongate protrusion 152 of the shaft 112 of the motor 114 to prevent the shaft 112 from rotating relative to the bolt 118 so that when the shaft 112 is rotated the bolt 118 also rotates.

The upper surface 120 also supports a fixture 154 that has bolts 156 being fixed but removably secured to the vise 102 by screwing the bolts 156 into threaded openings 158 on the upper surface 120. The fixture 154 has a groove 160 at a bottom surface 162 to receive an upper portion of the wedge 124. The block 130, with the plate 126 attached thereto, is movable or shiftable in the horizontal direction (H), by turning the bolt 118, so that blades can be captured and held between the plate 126 and the fixture 154, as described in detail below.

A covering plate 164 is attached to a second end 166 of the vise 102 to provide dust and particle protection to the vice 102. A bearing 168 is rotatably engaging the smooth section 142 of the bolt 118 that allows the bolt 118 to turn or rotate with minimum friction as rotatable or torque forces are applied to the bolt 118. The inset 108 has the function of preventing the bearing 168 from moving in the horizontal direction (H) so that the bearing 168 is captured between the inset 108 and the flange 140.

A U-shaped cover plate 170 is placed on top of the vise 102 to prevent or reduce dust and particles from moving into and through the vise 102.

A motor mounting plate 172 is mounted by bolts 174 to the end 104 of vise 102 by screwing the bolts 174 into openings 176 at the end 104. A lock-nut 178 is provided to prevent the bolt 118 from moving in the horizontal direction (H). The lock-nut 178 has a screw 180 that can be screwed against the bolt 118 to hold it in place. The motor mounting plate 172 attaches the motor 114 and gearbox 115 to the vise 102.

Figure 4:
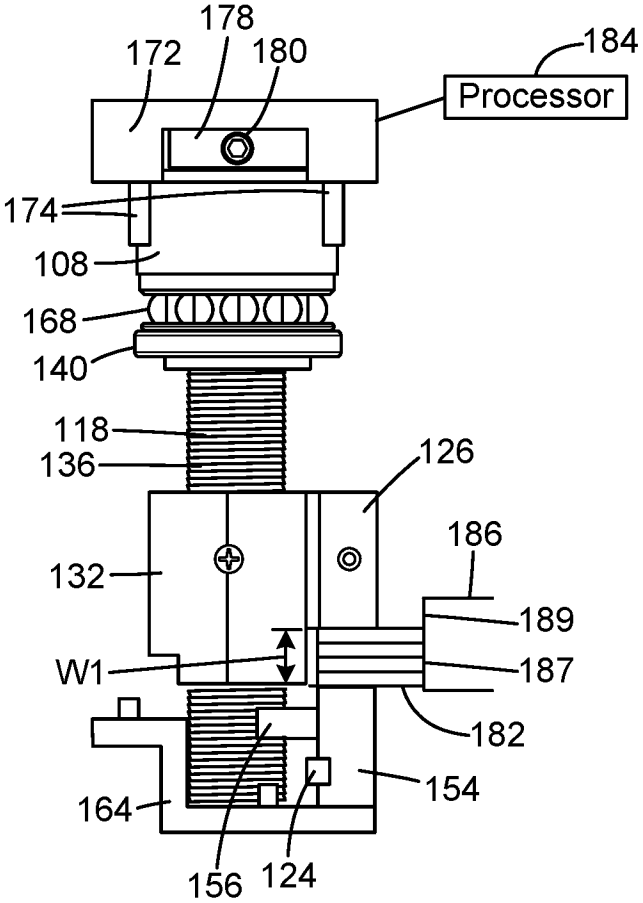
FIG. 4 is an elevation side of the portion of the blade holder of the present invention holding a plurality of blades.
Figure 3:
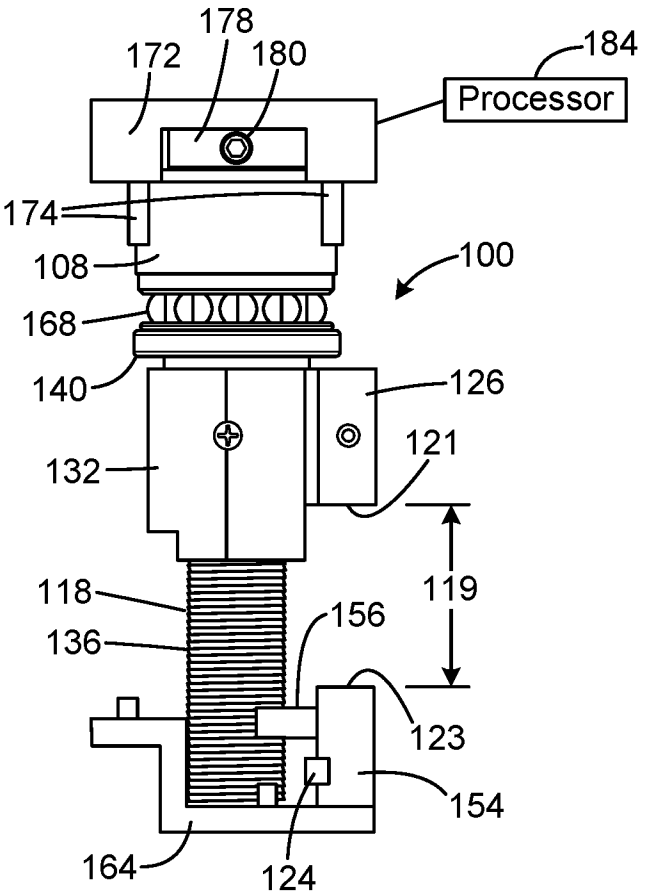
FIG. 3 is an elevational side view of a portion of the blade holder in an open position.

FIG. 3 shows the blade holder 100 in an open assembled position (with the vise 102 removed for clarity) while FIG. 4 shows the blade holder 100 in a closed position with a plurality of blades 182 held firmly between plate 126 and fixture 154. Each blade 182, such as a skate blade, is typically about 3 millimeters wide but other widths can also be used. The motor 114 rotates the shaft 112, via gearbox 115, a certain number of revolutions, which in turn, rotates the screw 118.

The blade holder 100 is connected to a computer processor 184 that runs on software. As mentioned earlier, the processor 184 keeps, among other things, track of the number of revolutions the shaft 112 has been rotated. The processor 184 also monitors the torque force required to rotate the shaft 112. While the blades 182 are loosely held between the plate 126 and the fixture 154 very little torque force of the motor 114 is required to turn the shaft 112 that is in operative engagement with the bolt 118 as the protrusion 152 engages the groove 150. The threaded portion 136 is in threaded operative engagement with the threaded opening 134 of block 132 so when the threaded portion 136 is rotated, the block 132 moves horizontally away or towards the flange 140. When a gripping side or engagement surface 121 of the plate 126 encounters and abuts the blades 182 to move the blades together the torque required to horizontally move the blades 182 increases. When all the blades 182 are in contact with one another, the torque required to further rotate the shaft 112 increases substantially to a threshold value. The processor 184 monitors the torque that is generated by the motor 114. When the torque required reaches the threshold value, the processor 184 determines the number of blades 182 that are held between the plate 126 and fixture 152 because the processor 184 has received input regarding the thickness of each blade 182 and the initial distance between the plate 126 and the fixture 154. The threshold value could be any suitable value such as 3-7 Nm. After the processor 182 has determined the number of blades 182 held by the blade holder 100, the processor 184 determine the final torque value that must be reached to firmly hold the plurality of blades 182 during the sharpening procedure of the blades. The final torque value could, for example, be 5-11 Nm but higher and lower values can also be used. The higher the number of blades held the higher the final torque value should be. By knowing the number of blades 182, the processor 184 also calculates the total width W of the set of blades 182. This width W1 wears on a first grinding section 187 of the rotating abrasive belt 186 as the rotating abrasive belt 186 grinds against the set of blades 182 to sharpen the blades. The belt 186 may have any suitable width such as 40 mm. After the sharpening of the blades 182 is complete, the processor 184, preferably, shifts the vise 102 horizontally, to a distance that is equivalent to the width W1, so that a non-worn second grinding portion 189 of the sharpening belt 186 is positioned over the next set of blades 191 that are to be sharpened, as explained below. The fact that the vise 102 can be shifted prolongs the useful life of the abrasive belt 186 and it also ensures that the belt sharpens evenly i.e. it prevents the worn section 187 to engage a portion of the blades while a non-worn section 189 engages another portion of the set of blades. Instead, the vise 102 is shifted until the non-worn portion 189 is aligned on top of the new set of blades 191 that has a width W2. Preferably, the vise 102 is only shifted between the sharpening sessions of each new set of blades. It may also be possible for the processor 184 to require a shifting of the vise 102 after a certain time period (such as 500 seconds) or after a certain number of revolutions of the motor that drives the belt 186. When the full width of the belt 186 has been used it is time to replace the belt 186 with a new non-worn belt.

Figure 5:
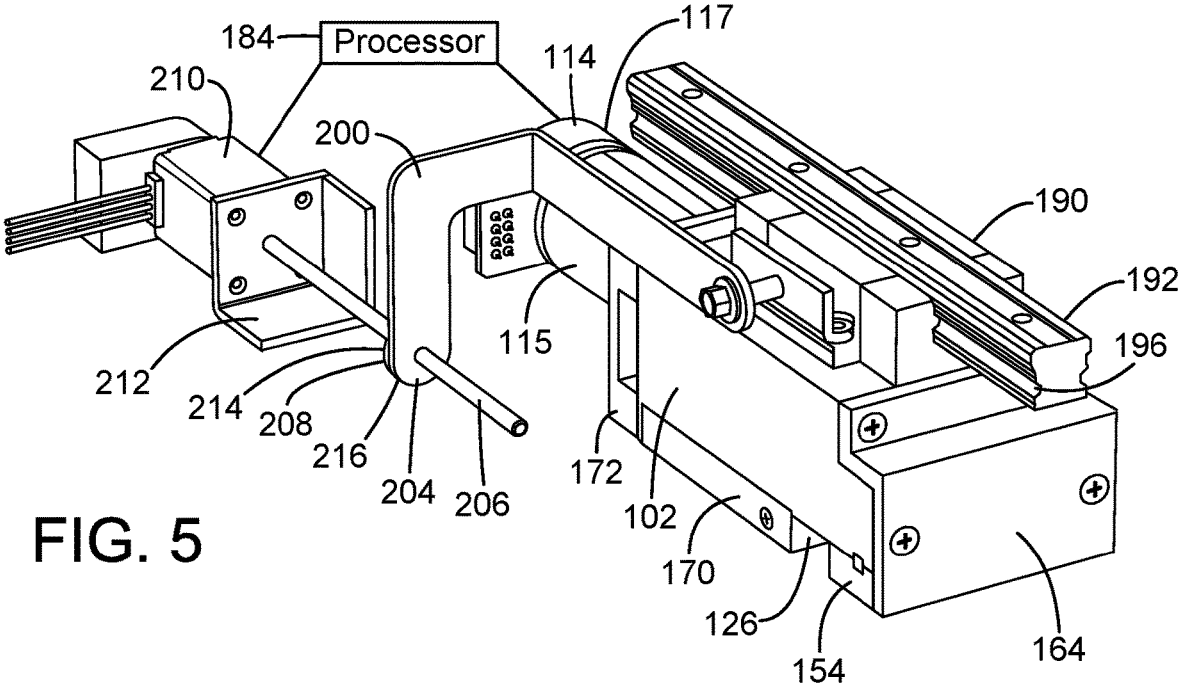
FIG. 5 is a perspective view of the blade holder of the present invention showing a shifting mechanism.
Figure 6:
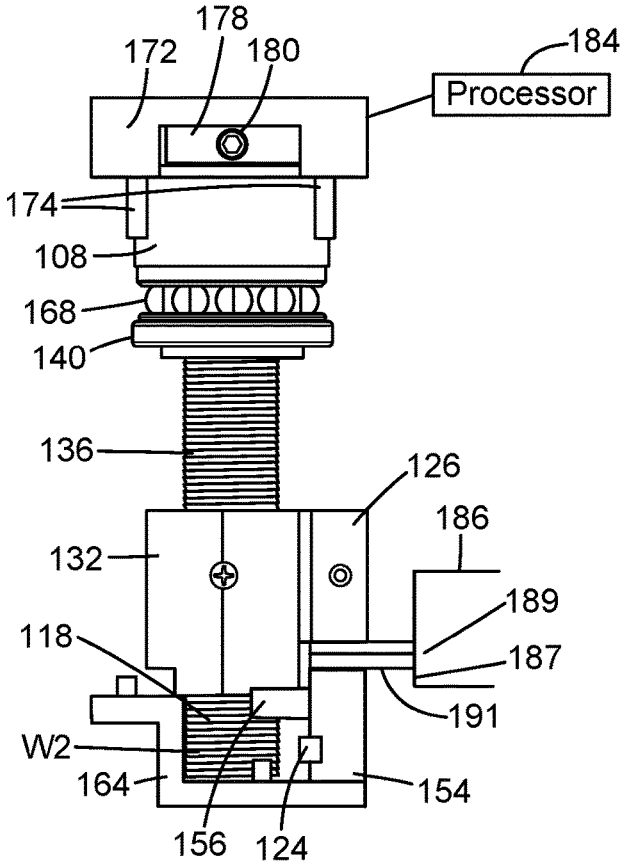
FIG. 6 is substantially similar to the view of FIG. 4 but shows the grinding belt shifted to the side to align a non-worn belt portion with the new set of blades to be sharpened.

FIG. 5 is a perspective view that shows the shifting mechanism on an underside of the blade holder 100. The vise 102 rests on and is attached to a slide 190 that is slidable on a linear rail 192 wherein elongate protrusions 194 of the slide 190 follow the elongate grooves 196 on the rail 192. A mounting bracket 198 is attached or secured to the slide 190. The bracket 198 is attached to angled metal piece 200 by a bolt 202. A bottom end 204 of the piece 200 is fastened to an elongate threaded piston or rod 206 by a threaded nut 208. By rotating the nut 208 the nut 208 travels along the rod 206. The rod 206 is in operative rotatable engagement with a linear actuator or electric motor 210 via a mounting bracket 212. The actuator 210 is also connected to the processor 184. The rod 206 has outside threaded portion 214 that is in operative engagement with inside thread 216 of the nut 208 so that when the rod 206 rotates the piece 200 moves away or towards the actuator 210 as the threaded rod 206 rotates inside the nut 208 that is secured to the bottom end 204. The software is programmed to know how many rotations of the rod 206 are equivalent to the width W of the blades 182 to be sharpened. Because the piece 200 is connected to the vise 102 and slide 190, horizontal movement of the piece 200 also moves the slide 190 relative to the rail 192. As mentioned above, the grinding or sharpening of a first set of blades 182 wears a portion W1 of the belt 186. Upon completion of the grinding of the first set of blades, it is possible to shift the slide 190 horizontally sideways so that a new non-worn portion 189 is aligned with a new set of blades 191, placed and firmly held between the plate 126 and the fixture 154, that are to be sharpened. In this way, it is not necessary to replace the belt 186 each time a new set of blades is to be sharpened because a non-worn portion 189 of the belt 186. In this way, the belt 186 can be used to sharpen many sets of blades until the entire width of the belt 186 is worn from grinding.

Figure 7:
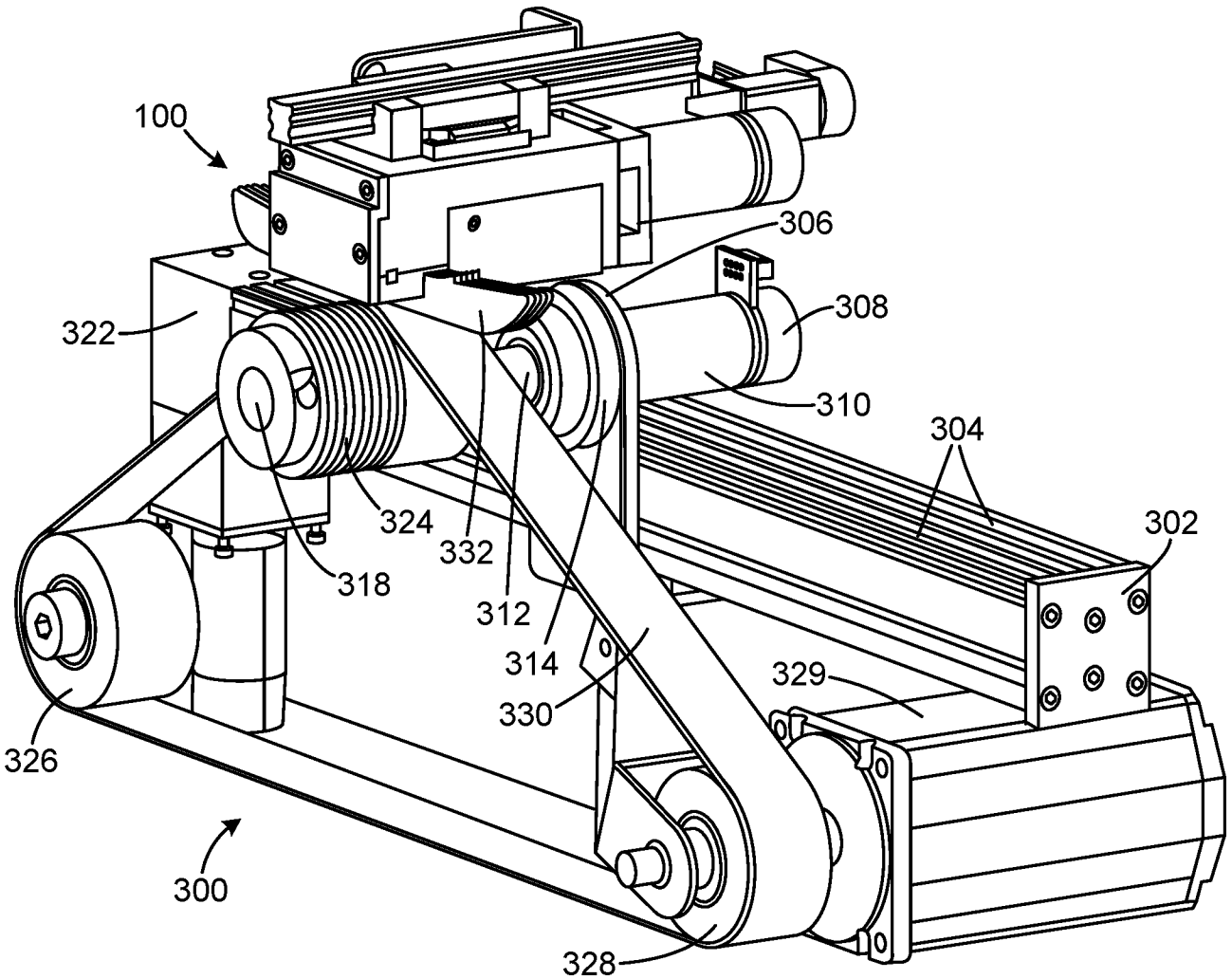
FIG. 7 is a perspective view of the blade holder of the present invention including an abrasive belt assembly.
Figure 8:
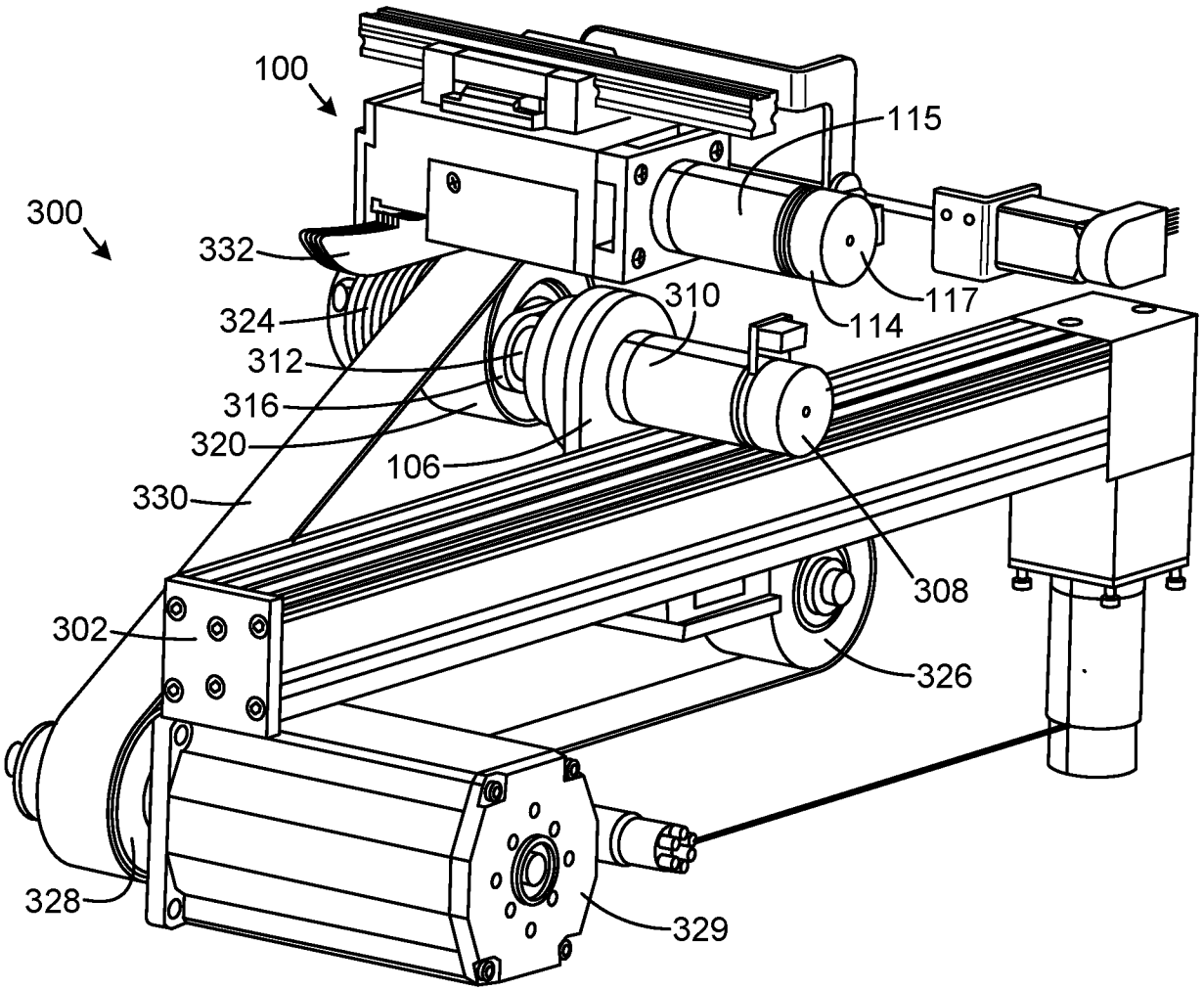
FIG. 8 is a perspective view of the blade holder of the present invention including the abrasive belt assembly shown in FIG. 7.

With reference to FIGS. 7-8, an elongate linear control unit assembly 300 includes an elongate control unit 302 that has a slide or rails 304 along which a contact wheel assembly 306 may slide. More particularly, underneath the linear control unit, the assembly 300 with a contact wheel is connected to the slide. The assembly 300 is fully computerized so that a computer calculated and controls the movement of the various components of assembly 300 via computer programs. The assembly is very dynamic and can be used to profile and sharpen virtually any profile of the blades because the abrasive belt and the rollers are very adaptive and can follow and digitally register/record the profiles of the blades so there is no need to use physical templates.

The assembly 300 and computer can thus be used to create profiling/grinding and sharpening programs based on the sensed or registered profiles by the contact wheel. It is to be understood that the present invention can also create virtually any profile because it is computer driven that creates profiles based on software. In other words, the assembly 300 may also be used to create virtually any profile of the blades by selecting a suitable sharpening/grinding program. It is also possible to do test or reference runs so that the contact wheel may follow the contour or profile of the blades to be ground. In this way, the motor 308 acts as a spring when the contact wheel follows the profile of the blade assembly. This "sensing" step by the contact wheel is done without rotating the abrasive belt. In this way, the computer can determine the location and profile of the blades by creating a reference program so that the computer can calculate how to best grind the blades to create the desired profile. The computer may be used to set different grinding pressures depending upon the number of blades that are to be ground or sharpened. The computer may also adjust the speed of the sideways movement of the contact wheel depending upon how many blades are to be profiled/ground and the effect of the motor driving the abrasive belt. The motor effect and the sideways movement of the contact wheel are thus adjusted to one another to optimize the grinding along an optimized effect curve so that a constant grinding pressure can be used. When the maximum effect of the motor is required then the computer, preferably, lowers the speed of the sideways movement of the contact wheel as the linear control unit moves horizontally so that the most optimal grinding results are accomplished. Preferably, the blades are fixedly held by the blade holder. The contact wheel is thus the part that is moving sideways. The computer may also determine how worn the abrasive belt is and the particle size on the abrasive belt based on the performance of the belt as it is used for grinding the blades. Preferably, the abrasive belt is used for creating profiles of several blades that are held together by the blade holder. As described in detail below, the actual sharpening of a blade is, preferably, done by a disc that has the desired convex grinding shape and the blades are then sharpened one by one. The blade holder places or sideways shift the blade to be sharpened over the disc that has the selected shape radius. The software may be programmed with the position of each type of disc on the spindle so that blade holder can be shifted the correct distance to be placed over the desired disc.

An important feature of the assembly 300 is that it is designed to be able to control the position of the contact wheel 320 and the spindle 322 both horizontally and vertically, as explained below. The vertical and horizontal positions are determined by the angle of the positioning axle 312 that is turned by the motor 308. By using a gearbox 310 a high precision can be obtained as well as a high torque. Preferably, the contact wheel 320 is designed to follow a coordinate program to grind the bottom surface of the blades 332 that are held above the contact wheel 320. This results in a function that has virtually no limitations regarding how the skate profile of the blades can be ground. More particularly, the assembly 306 includes an electric motor 308 in operative engagement with a gearbox 310. A rotatable axle or rod 312 protrudes from the gearbox 310 through a bearing house 314. The axle 312 is rotatably attached to an end of an arm 316. The opposite end of the arm 316 is rotatably attached to an axle 318 that extends through a contact wheel 320 and an adjacent spindle 322 that has a plurality of grinding wheels 324 mounted thereon so that the contact wheel 320 rotates, the grinding wheels 324 rotate also. The construction of the spindle 322, discs 324 and the contact wheel 320 enables the discs 324 and contact wheel 320 to be moved both in a horizontal and vertical direction along a circular path because of the linear control unit 302 as well as a result of rotating the axle 312. The contact wheel 320 is thus eccentrically mounted relative to the axle 312 so that the second axle 318 is off-center or shifted away from the first axle 312. This makes it possible to move the contact wheel 320 relative to the first axle 312 so that the exact position of the wheel 320 may be adjusted in the horizontal and vertical directions along the circular path by rotating the axle 312 in a first or a second opposite direction. Preferably, the contact wheel 320 may rotate freely because of its built-in double bearing construction. The assembly 300 also has a first adjustable roller 326 and a second roller 328 so that the contact wheel 320, rollers 326, 328 may carry an abrasive belt 330. The roller 328 is in operative engagement with a motor 329 that drives the abrasive belt. Preferably, the roller 326 is adjustable to create a tension of the belt 330 and adjusts its position to horizontal and vertical movement of the contact wheel 320 in engagement with the non-elastic belt 330 when the contact wheel 320 follows the profile of the blades to be profiled or sharpened. The rotatable abrasive belt 330 may be used to grind the blades 332. The vertical movement of the contact wheel 320 and spindle 322 is fully controlled by the electric motor 308.

While the present invention has been described in accordance with preferred compositions and embodiments, it is to be understood that certain substitutions and alterations may be made thereto without departing from the spirit and scope of the following claims.

We claim:

1. An ice skate blade sharpening apparatus, comprising:

a blade holder configured to grip a set of one or more ice skate blades placed therein;

an abrasive belt having a width, the abrasive belt providing a first grinding portion spanning a first portion of the width of the abrasive belt and a second grinding portion spanning a second portion of the width of the abrasive belt;

the blade holder being mounted with respect to the abrasive belt so as to be laterally shiftable in a direction of the width of the belt by aid of an actuator;

a processor configured for:

causing the first grinding portion of the abrasive belt to be applied against the set of one or more ice skate blades to sharpen the one or more ice skate blades; and controlling the actuator so as to laterally shift the blade holder a distance of at least the first portion of the width of the abrasive belt, to prepare for sharpening of a second set of one or more ice skate blades with the second grinding portion of the abrasive belt.

2. The ice skate blade sharpening apparatus of claim 1, wherein said controlling the actuator so as to laterally shift the blade holder is automatically carried out after a pre-designated period of time.

3. The ice skate blade sharpening apparatus of claim 1, wherein the apparatus further comprises a motor for driving the abrasive belt and wherein said controlling the actuator so as to laterally shift the blade holder is automatically carried out after a pre-designated number of revolutions of the motor driving the abrasive belt.

4. The ice skate blade sharpening apparatus of claim 1, wherein the distance of the at least first portion of the width of the abrasive belt is equivalent to a total width of the set of one or more ice skate blades.

5. The ice skate blade sharpening apparatus of claim 4, wherein the processor is configured for determining the total width of the set of one or more ice skate blades.

6. The ice skate blade sharpening apparatus of claim 5, wherein said determining the total width of the set of one or more ice skate blades is based on a number of ice skate blades in the set of one or more ice skate blades.

7. The ice skate blade sharpening apparatus of claim 6, wherein the processor is configured for determining the number of ice skate blades in the set of one or more ice skate blades.

8. The ice skate blade sharpening apparatus of claim 7, wherein the blade holder includes lateral holding parts at least one of which being movable relative to the other, and wherein the processor is further configured for:

causing a motor to move at least one of the lateral holding parts relative to the other to grip the set of one or more ice skate blades placed therebetween;

monitoring torque or force generated by the motor;

upon determining that the torque or force generated by the motor has reached a threshold torque value or threshold force value, determining a gripping gap between the lateral holding parts;

determining a number of ice skate blades in the set based at least in part on the gripping gap; and outputting the determined number of ice skate blades via a use interface or storing the determined number of ice skate blades in a memory.

9. The ice skate blade sharpening apparatus of claim 1, wherein the apparatus further comprises a slide coupled to the blade holder, the slide being movable along a rail coupled to the apparatus to laterally shift the blade holder relative to the abrasive belt.

* * * * *